United States Patent [19]

Rublack

[11] 4,066,924

[45] Jan. 3, 1978

[54] SCREEN FOR SLOTTED APERTURE MASK COLOR TELEVISION PICTURE TUBE

[75] Inventor: Wilfred Rublack, Liverpool, N.Y.

[73] Assignee: General Electric Company, Portsmouth, Va.

[21] Appl. No.: 595,260

[22] Filed: July 11, 1975

Related U.S. Application Data

[63] Continuation of Ser. No. 472,349, May 22, 1974, abandoned.

[51] Int. Cl.[2] ..... H01J 29/28; H01J 29/32; H01J 31/20

[52] U.S. Cl. ..... 313/408; 313/470

[58] Field of Search ..... 313/403, 408, 470

[56] References Cited

U.S. PATENT DOCUMENTS

| | | | |
|---|---|---|---|
| 3,146,368 | 8/1964 | Fiore et al. | 313/408 |
| 3,247,412 | 4/1966 | Barneveld et al. | 313/470 |
| 3,558,310 | 1/1971 | Mayaud | 96/36.1 |
| 3,685,994 | 8/1972 | Frey | 96/36.1 |
| 3,731,129 | 5/1973 | Tsuneta et al. | 313/408 |
| 3,801,817 | 4/1974 | Goodman | 250/365 |
| 3,900,757 | 8/1975 | Kaplan | 313/408 X |

OTHER PUBLICATIONS

Toshiba, "Blackstripe Vertical Stripe Screen Colour Picture Tube", 1973.

*Primary Examiner*—Robert Segal

[57] ABSTRACT

A black matrix screen for a slotted mask color television picture tube is printed using a shortened linear source of actinic radiation to result in deposition of black matrix material in the shadows of the mask webs appearing in the phosphor stripe area. Screen reflectivity is thereby reduced and contrast enhanced. By controlling vertical size of the black matrix material in the shadow cast by each respective web between vertically-adjacent slots, the tube may be made either positive or negative guard-band in the vertical direction.

3 Claims, 16 Drawing Figures

SCREEN FOR SLOTTED APERTURE MASK COLOR TELEVISION PICTURE TUBE

INTRODUCTION

This is a continuation of application Ser. No. 472,349, filed May 22, 1974 now abandoned.

This invention relates to cathode ray tube screens, and more particularly to black matrix screens for color television picture tubes employing slotted aperture masks and a process for fabricating such screens.

Manufacturers of cathode ray tubes of the color television picture tube type have recently begun employing aperture masks having slotted apertures instead of the more conventional circular apertures in order to achieve greater electron beam transmission through the mask, since an array of slots in an aperture mask allows the mask geometrically to be fabricated with more total open area than the same size mask containing round or circular apertures. The slotted apertures are typically arranged in vertical columns on the mask, each column being comprised of a plurality of slotted apertures. Since more electrons can impinge on the phosphor regions of the screen in a tube of this type than of the circular aperture, mask type, a brighter picture results. Unlike the circularly-configured phosphor regions on the screen of a tube employing an aperture mask having circular apertures, however, the phosphor regions on the screen of a tube employing an aperture mask having slotted apertures are formed in a pattern of adjacent vertical stripes, typically with each stripe running continuously from the top of the screen to the bottom.

Black matrix tubes have also become widely popular as of late, both in circular aperture mask tubes and slotted aperture mask tubes. As seen from the viewing side of the screen of circular aperture mask tubes, the black matrix material completely surrounds each circular phosphor dot, serving to improve image contrast by absorbing ambient light that might otherwise be reflected by the screen. Also as seen from the viewing side of the screen of slotted aperture mask tubes, each vertical phosphor stripe is separated from the adjacent vertical phosphor stripe by a stripe of black matrix material running from the bottom to the top of the screen.

In fabricating screens for conventional slotted aperture mask tubes of the black matrix type, a photoresist material coated over the inside surface of a tube faceplate is exposed in a so-called lighthouse to actinic radiation in a pattern corresponding to the pattern of matrix openings ultimately to be formed on the screen. This radiation is transmitted through the slotted apertures in the mask before impinging on the photoresist material. The actinic light source used in this fabrication process is linearly-elongated in a direction parallel to the columns of slots in the aperture mask in order to permit the black matrix material to be formed with a pattern of vertically and horizontally-aligned, vertically-oriented slots extending between the top and bottom of the screen. The phosphor stripes are thereafter deposited so that phosphor of a predetermined color emission characteristic, respectively, is deposited on the faceplate through a predetermined slot, respectively. Three different phosphor materials are conventionally deposited in a horizontally-repetitive pattern.

When a screen formed in the aforementioned manner is operated in a color television picture tube, parts of each of the phosphor stripes are not excited by the electron beams, since electrons are blocked by the webs of the mask between vertically-adjacent slots. These parts of the stripes, therefore, are essentially useless in producing images, since they provide no illumination on the face of the tube as a result of direct bombardment by primary electrons. Moreover, the phosphor material in these regions adds to overall reflectivity of the screen and hence has a deleterious effect on image contrast. To overcome this problem, the present invention contemplates substituting black matrix material to be seen from the viewing side of the screen to avoid reflection from the parts of the phosphor stripes not excited by the electron beams. This may be accomplished by using a source of actinic radiation for producing slotted openings in the black matrix material that is of shorter length than the linear source of actinic radiation for producing the phosphor stripes. The resulting increase in area of black matrix material serves to reduce screen reflectivity and enhance contrast of the displayed images. Moreover, by controlling vertical size of the mask webs between vertically-adjacent openings in the black matrix material, either a positive guardband or negative guardband mode of operation in the vertical direction may be achieved.

Accordingly, one object of the invention is to provide a new and improved color television picture tube of the black matrix type exhibiting reduced screen reflectivity and enhanced image contrast.

Another object is to provide a color television picture tube of the slotted aperture mask type having a screen, as seen from the viewing side, formed of a plurality of vertically-oriented linear phosphor regions completely surrounded by black matrix material.

Another object is to provide a black matrix color television picture tube of the slotted aperture mask type capable of operating in a positive or negative guardband mode of operation in the vertical direction.

A further object is to provide a black matrix color television picture tube wherein the vertical guardband of the matrix is controlled to enhance image contrast without reducing image brightness.

Another object is to provide a method of fabricating a color television picture tube of the black matrix type wherein exposures to different levels of actinic radiation are employed sequentially in forming the picture tube screen.

Briefly, in accordance with a preferred embodiment of the invention, a viewing screen is provided for a cathode ray tube. The tube includes a faceplate and employs a shadow mask containing an array of vertically-oriented slotted apertures for restricting electron beams directed therethrough to impinge on, and excite, selected areas of phosphor material on the faceplate. The viewing screen comprises a layer of light-absorbing material coated over the inside surface of the faceplate, with the layer including a pattern of vertically-elongated openings therein, and a plurality of vertically-oriented stripes of phosphor material arranged such that horizontally successive stripes are comprised of different phosphor materials according to a repeating pattern. Each of the stripes, respectively, is coated over substantially the entire area of all the elongated openings situated essentially in separate vertical alignment, respectively.

In accordance with another preferred embodiment of the invention, a method of forming on the faceplate of a cathode ray tube a viewing screen for a high contrast color television picture tube of the slotted aperture mask, black matrix type is described. The method comprises forming a first layer of photosensitive material on the inside surface of the faceplate and exposing the photosensitive material to actinic radiation through slotted apertures in the mask from a first linear radiation source of predetermined dimension along its longitudinal axis. The longitudinal axis of the first source is maintained substantially parallel to the longitudinal axis of the slotted apertures. The unexposed regions of the first layer of photosensitive material are then removed, and a layer of black matrix material is formed atop the first layer of photosensitive material and the inside surface of the faceplate. The exposed regions of the first layer of photosensitive material and the black matrix material coated thereon are next removed, leaving openings in the black matrix material. A second layer of photosensitive material is formed atop the black matrix material coated on the inside surface of the faceplate and atop the exposed portions of the inside surface of the faceplate. The second layer of photosensitive material carries a phosphor material either coated thereon or mixed therein, emitting a characteristic color of light when excited by electrons. This is followed by exposing the second layer of photosensitive material to actinic radiation through the slotted apertures from a second linear radiation source of dimension along its longitudinal axis exceeding the predetermined dimension, the longitudinal axis of the second source also being substantially parallel to the longitudinal axis of the slotted apertures. The unexposed regions of the second layer of photosensitive material are then removed. In this fashion, phosphor material is applied over the inside surface of the faceplate in registry with the openings in the black matrix layer. If desired, the phosphor material may be applied in the form of vertical stripes extending between the top and bottom of the screen by increasing the length of the second radiation source, increasing the duration of exposure therefrom, or a combination of both.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIGS. 8A–8G are graphical illustrations of viewing screen exposure intensity resulting from use of different length actinic radiation sources.

DESCRIPTION OF TYPICAL EMBODIMENTS

Figure 1:
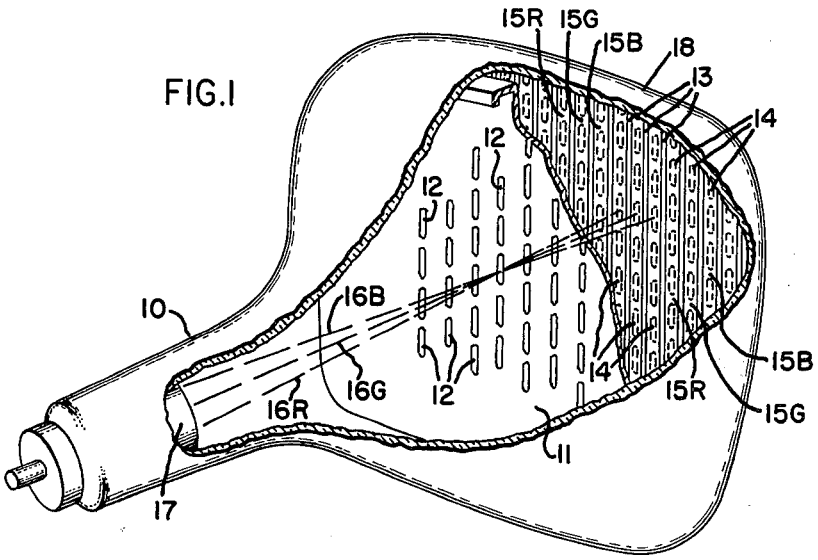
FIG. 1 is a partially cutaway, perspective view of a color television picture tube employing the instant invention.

In FIG. 1, a cathode ray tube 10 of the color television picture tube type constructed according to the invention is shown with its envelope partially broken away to reveal an aperture mask 11 containing a regular array of apertures comprising vertical slots 12. The faceplate or viewing screen portion 18 of the tube contains a light-absorbing material 13, often referred to as black matrix, such as graphite which has been deposited as a coating in the form of a colloidal suspension of fine graphite particles in water and thereafter dried. The colloidal suspension is sold under the trademark Aquadag and is available from Acheson Colloids Company, Port Huron, Michigan.

Light-absorbing material 13 contains openings or slots 14 therein over which phosphor materials 15B, 15G and 15R are coated. Phosphor materials 15B, 15G and 15R are visible from faceplate 18 of tube 10 through openings 14, and produce blue, green and red light, respectively, when excited by an appropriate electron beam 16B, 16G and 16R, respectively. Materials 15B, 15G and 15R exist in repetitive fashion in the horizontal direction across light-absorbing material 13, and may conveniently be formed in continuous vertical stripes extending between the top and bottom of the viewing screen. Unitary area of black matrix material 13, containing a repeating pattern of openings 14 therein extending in both horizontal and vertical directions, covers the interior surface of the entire front portion 18 of the tube. Tube 10 is of the inline type such that electron beams 16B, 16G and 16R are emitted in coplanar fashion from electron gun assembly 17 and pass through predetermined apertures 12 in shadow mask 11 to impinge on selected phosphor regions.

Figure 2:
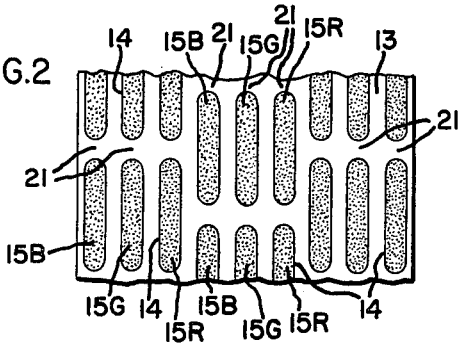
FIG. 2 is a front view of a segment of the screen used in the picture tube of FIG. 1.

In FIG. 2, a segment of a screen for inline tube 10 of FIG. 1 is shown as viewed through the tube faceplate (not illustrated). Unitary layer of black matrix material 13 deposited on the inside surface of the tube faceplate surounds each of openings 14 therein. Red, green and blue phosphor material 15R, 15G and 15B, respectively, is visible from the tube faceplate through openings 14. The phosphor material is typically deposited in continuous vertical stripes atop black matrix material 13, each stripe covering a vertical column of alternate openings 14 in matrix material 13 and horizontal webs 21 of matrix material 13. Webs 11 define the ends of discrete vertical slots 14 in the black matrix material underlying the phosphor stripes, preventing any single vertical slot beneath any phosphor stripe from extending the full height of the viewing screen.

Figure 3:
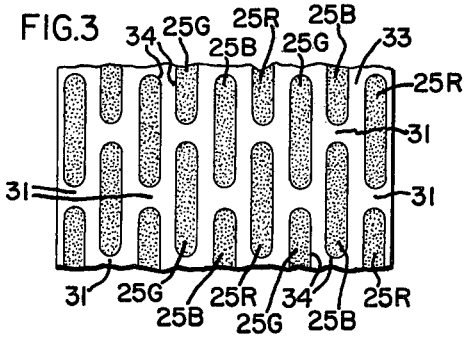
FIG. 3 is a front view of a central segment of another type of screen embodying the invention that may be utilized in a color television picture tube.

FIG. 3 illustrates a central segment of a screen for a delta tube, or tube wherein each of the electron beams is emitted from an electron gun assembly at the separate corners, respectively, of an equilateral triangle. A unitary layer of black matrix material 33 surrounds each of vertical slots or openings 34 therein. Red, green and blue phosphor material 25R, 25G and 25B, respectively, is visible through openings 34, as seen through the tube faceplate (not illustrated). As in the embodiment of FIG. 2, the phosphor material is typically deposited in continuous vertical stripes atop black matrix material 33, each stripe covering a vertical column of alternate openings 34 in matrix material 33 and horizontal webs 31 of matrix material 33. Webs 31 define the ends of discrete vertical slots 34 in the black matrix material underlying the phosphor stripes, preventing any single vertical slot beneath any vertical stripe from extending the full height of the viewing screen.

The viewing screen configuration for a tube containing a delta electron gun assembly differs from the viewing screen configuration for a tube containing an inline electron gun assembly. Specifically, webs 21 of black matrix material in the inline screen structure shown in FIG. 2 are located substantially at the same vertical levels for each trio of different phosphor stripes, with each trio of different phosphor stripes overcoating black matrix webs at vertical locations on the viewing screen midway between the vertical locations of black matrix webs beneath phosphor stripes in each adjacent trio of different phosphor stripes. In the delta tube embodiment of FIG. 3, however, webs 31 of black matrix material overcoated by the three phosphor stripes of any one trio are located at the vertices of a substantially equilateral triangle, with each trio of different phosphor stripes overcoating black matrix webs at vertical locations on the viewing screen, respectively, midway between the vertical locations of black matrix webs beneath the corresponding phosphor stripes in each adjacent trio of different phosphor stripes, respectively.

Figure 4:
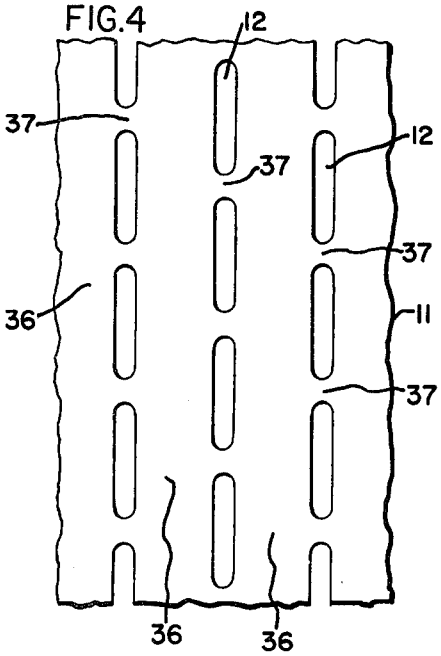
FIG. 4 is a plan view of a segment of the aperture mask used in the picture tube of FIG. 1.

FIG. 4 is a plan view of a segment of shadow mask 11, shown in tube 10 of FIG. 1. The mask contains uniform vertical slots 12 in a regular array such that the vertical locations of slots in each vertical column of slots are situated midway between the vertical locations of slots in each adjacent vertical column of slots. The pattern of slots in mask 11 may be employed in either inline or delta picture tubes.

Mask 11 is typically fabricated of metal, so that electron beams impinging on the mask are blocked by the mask except in the area of slots 12. Thus, electrons impinging on the mask between any pair of horizontally-adjacent columns of slots 12 are blocked by the mask material 36, while electron beams impinging on any of webs 37 defining the ends of each of vertically-adjacent slots 12 are likewise blocked by the mask material. The width of each of slots 12 is usually slightly less than the width of the phosphor stripes on the viewing screen. Since the electron beam passing through a slot 12 in mask 11 expands slightly in cross-sectional area as it approaches the screen, the electron beam width, when the beam strikes the screen, approximately matches the width of the phosphor stripe excited thereby.

Figure 5:
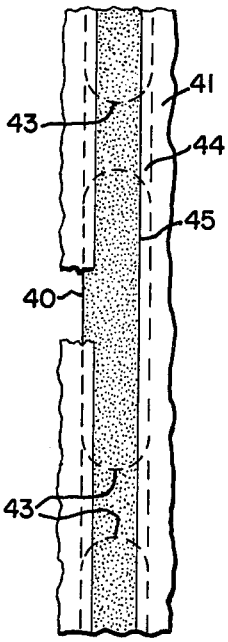
FIG.5 (PRIOR ART)
FIG. 5 is an illustration of details involved in operating a slotted mask picture tube of the black matrix type known in the prior art.

FIG. 5 is a plan view of a segment of a conventional type of screen for use with a slotted mask color picture tube of the black matrix type, as viewed from the tube faceplate (not shown). In tubes of this type, black matrix material 41 is deposited on the inner surface of the picture tube faceplate, and continuous vertical openings or slits 45, extendng the entire distance between the top and bottom of the screen, are formed in the black matrix material. Continuous phosphor stripes, such as stripe 40, are then deposited on the inner surface of the picture tube screen, extending between the top and bottom of the screen, so as to completely cover each of openings 45 formed in the black matrix material. Typically, the phosphor stripes overlap the vertical sides of the openings in the black matrix material. To form a completed tube, the stripes are formed in a repetitive pattern which allows successive phosphor stripes to emit red, green and blue light, respectively, when excited by an electron beam.

In a picture tube employing a slotted aperture mask of the type shown in FIG. 4, regions 43 of FIG. 5 are capable of exposure to electron beams and, when excited by such electrons, produce the images viewed on the screen. Those skilled in the art will recognize that while the entire area of phosphor exposed to electrons in regions 43 is capable of emitting light, black matrix material 41 absorbs most of the outward-directed light produced by the portion 44 of phosphor material 40 coated on the black matrix material. Thus the edge of black matrix material 41 at each slit 45 therein determines the vertical shape of light emitted by the phosphor stripes. Slotted mask tubes constructed in this manner are capable of producing images with better contrast than slotted mask tubes without black matrix in that the black matrix material tends to absorb ambient light and thereby increase visibility of the light produced by excited phosphors. Additionally, the black matrix material situated between adjacent slits therein through which light from excited phosphor stripes emerges allows the electron beam to be slightly wider than the width of the slits in the black matrix material so as to permit slight imprecision in the horizontal landing area of the electron beam without any adverse effect on quality of images displayed by the tube.

Figure 6A:
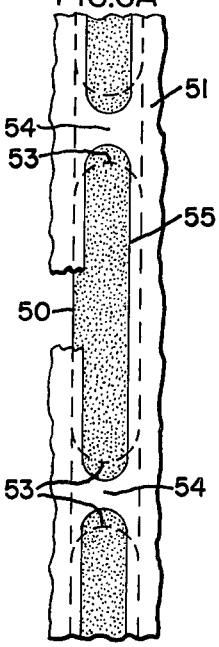
FIGS. 6A and 6B are illustrations of details involved in operating the slotted mask picture tube of the instant invention in different modes.

FIG. 6A is a plan view of a segment of a black matrix viewing screen for use with a slotted mask tube, constructed in accordance with one embodiment of the invention, and viewed from the tube faceplate (not shown). As with the screen of FIG. 5, black matrix material 51 is deposited on the entire inner surface of the picture tube faceplate, and vertical openings or slots 55 extending over predetermined distances between the top and bottom of the screen are formed in the black matrix material. Slots 55 are separated from each other by webs 54 of black matrix material. Phosphor stripes, such as stripe 50, are then deposited on the inner surface of the picture tube screen. Stripes 50 extend vertically between the top and bottom of the screen, and may either be continuous, as shown, or discontinuous, provided each stripe completely covers each of slots 55 in the black matrix material over which it is deposited. Typically, the phosphor stripes overlap the vertical sides of the openings in the black matrix material.

To form a completed tube having a viewing screen of configuration shown in FIG. 6A, the phosphor stripes are formed in a pattern which is repetitive in the horizontal direction, allowing horizontally-successive phosphor stripes to emit red, green and blue light, respectively, when excited by an electron beam. Thus the screen comprises an integral area of black matrix material containing openings 55 therein through which phosphor material 50 is visible. The vertical height of openings 55 is greater than the vertical height of region 53 on stripe 50, which represents the beam landings or area of phosphor material capable of exposure to electron beams when the mask of FIG. 4 is employed in the tube containing the screen of FIG. 6A. Thus, the portions of phosphor material 50 visible through openings 55 in black matrix material 51 above and below the vertical boundaries of regions 53 are incapable of being energized by electrons in the tube in which the screen is situated. In the vertical direction, this type of configuration is sometimes referred to as "positive guardband" in that the electron beam cross-section 53 is shorter than the height of the portion of phosphor material 50 visible through any slot 55 in black matrix material 51.

A major advantage in using a screen of the type illustrated by FIG. 6A instead of a screen of the type illustrated by FIG. 5 is that webs 54 of black matrix material increase the total area of black matrix material generally uniformly over the entire viewing screen of the tube, so as to provide increased contrast in displayed images. The increased contrast is achieved without any decrease in brightness, since webs 54 are situated beneath, or displace, portions of phosphor material that would never be energized. In this manner, the web 54 can extend vertically up to the bottom edge of the upper one of two vertically adjacent beam landings 53 and down to the upper edge of the lower beam landing, so as to provide a zero guardband between beam landings, or can extend only partially between the adjacent beam landings, as shown in FIG. 6A, to provide a positive vertical guardband. Moreover, a reflective backing over the phosphor stripes in the picture tube of FIG. 5, as is provided when the tube is aluminized according to conventional practice, substantially fails to improve brightness of displayed images in areas coinciding with the vertical separation between adjacent regions 43, and indeed detracts from contrast in that additional reflectivity is furnished to ambient light which penetrates the phosphor material, without any added reflectivity to light omitted by the phosphor material. Webs 54 preclude this effect in tubes employing the screen of configuration shown in FIG. 6A.

Figure 6B:
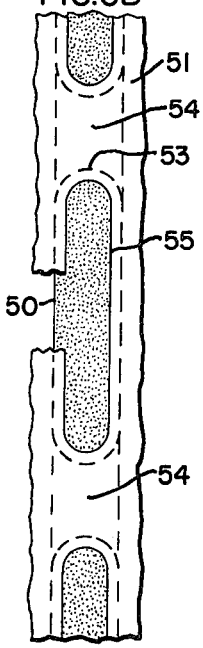

FIG. 6B is a plan view of a segment of a black matrix viewing screen for use with a slotted mask, tube, constructed in accordance with a second embodiment of the invention, and viewed from the tube faceplate (not shown). In this embodiment, the vertical height of slots 55 is made less than the vertical height of regions 53. This results in larger webs 54 of black matrix material than in the embodiment of FIG. 6A. Thus, the entire portion of phosphor material 50 which is visible through openings 55 is capable of emitting optical radiation because of excitation by an electron beam. In the vertical direction, this type of configuration is sometimes referred to as "negative guardband" in that electron beam cross-section 53 is at least as long as the height of the portion of phosphor material 50 visible through any slot 55 in black matrix material 54. Of course, in the screen configurations shown in FIGS. 6A and 6B, the phosphor material encompassed within regions 53 but outside the periphery of slots 55 also radiates slightly, but most of this radiation is prevented, by absorption in black matrix material 51, from having any major effect on the light produced by phosphor 50 through slots 55 in either embodiment of the screen. Thus, while a tube constructed in accordance with the screen embodiment of FIG. 6B achieves substantially the same brightness as a tube constructed in accordance with the screen embodiment of FIG. 6A, greater contrast is achieved with a tube constructed in accordance with the screen embodiment of FIG. 6B.

In order to produce a pattern of phosphor stripes on the screen of the tube, the screen is typically formed by photographic techniques whereby a photosensitive film coated on the interior surface of the tube faceplate is exposed to acetinic radiation through the vertical slots in the shadow mask to be emploted in the tube. Since utilization of a small annular area source of radiation, or so-called "point source," results in shadows on the screen cast by the metal webs vertically separating the mask slots, such as webs 37 shown in FIG. 4, the areas to be coated with phosphor on the screen would appear as a pattern of vertically and horizontally aligned stripes were such source of actinic radiation to be employed. In order to produce uniform stripes of phosphor, each extending continously from the top to the bottom of the screen, long, narrow sources of actinic radiation or so-called "line sources have been employed. These "line sources" are oriented such that their longitudinal axes are substantially parallel to the longitudinal axes of slots in the shadow mask, thus causing illumination which eliminates shadows cast by the webs vertically separating the slots in the mask. Consequently, the resulting screen structure takes the form shown in FIG. 5. However, by exposing a photosensitive film to a "point source" or short "line source" of actinic radiation for a predetermined time to produce a unitary black matrix area having slots formed therein, in the manner similar to that conventionally employed for producing black matrix tube screens having circular apertures formed therein through which phosphor dots are deposited over the tube faceplate, followed by exposure from a much longer "line source", or for a longer period of time from the same "point source" or short "line source," of a second photosensitive film carrying phosphor material and coated atop the faceplate underlying the black matrix material, phosphor material is formed over the black matrix material in the manner shown in FIGS. 6A and 6B. The second exposure is performed three times for a tri-color tube, each time employing a new second photosensitive film carrying a separate type of phosphor material, respectively, to allow deposition of each type of phosphor material in separate locations, respectively. The application of phosphor material may be carried out according to conventional procedures, such as by the well-known dusting or slurry methods.

The various types of openings in the black matrix material illustrated in FIGS. 5, 6A and 6B may be generated by using the same slotted shadow mask and varying the exposure (which may be defined as the product of radiation intensity and time) to actinic radiation, and by varying the length of the radiation source in a direction parallel to the long dimension of each slot in the mask. However, an approximate point source of radiation is preferably used in fabricating the geometry of openings in the black matrix material illustrated in FIG. 6B. The source employed in fabricating a screen of the type illustrated in FIG. 5, wherein no image of the webs between vertically-adjacent mask slots is produced, is generally quite long, typically on the order of 0.5 inches to 1.5 inches, depending on shadow mask and picture tube geometries.

The sizes of openings 55 in black matrix material 51, as shown in FIGS. 6A and 6B, are determined by the sizes of the areas of photosensitive film on the interior surface of the tube faceplate which experience exposure equal to, or exceeding, a critical value. This exposure is proportional to a relative intensity of the light pattern distribution over a given time. It is therefore necessary, for the particular photoresist process employed, to determine the radiation source length and exposure time to yield the proper size of web 54 of black matrix material.

Figure 7A:
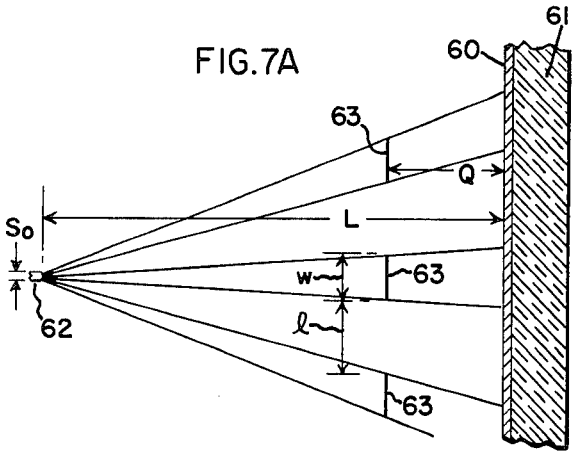
FIGS. 7A and 7B illustrate geometrical relationships involved in fabricating screens for color television picture tubes according to the present invention.

In analyzing exposure patterns for the screens of FIGS. 5, 6A and 6B, consider first the use of a point source of actinic radiation, as shown in FIG. 7A. Photosensitive film 60 on glass substrate 61, which ultimately is to constitute the faceplate of a finished color television picture tube, is exposed to actinic radiation from an approximate point source 62 of length $S_0$, through apertures of vertical length $l$ in a shadow mask 63. Vertical separation between openings in the shadow mask (i.e., the vertical web length) is a distance $w$, while spacing between the shadow mask and photoresist layer 60 is a distance Q. Spacing between source 62 and photoresist layer 60 is L.

From the tube geometry, there are three magnification quantities that may be defined.

$$\text{Shadow magnification, } M_S = \frac{L}{L-Q}$$

$$\text{Image magnification, } M_i = \frac{Q}{L-Q} = M_S - 1$$

$$\text{Reflected magnification, } M_r = \frac{L}{Q} = \frac{M_S}{M_i}.$$

Along a vertical line on the shadow mask, the vertical repeat $v$ may be defined as $$v = l + w.$$

Point source of actinic radiation 62 casts a sharp image of the shadow mask geometry onto photoresist layer 60 with magnification $M_S$. The corresponding opening or slot formed in the subsequently-deposited black matrix layer after processing then has a vertical dimension $$B' = l\,M_S$$

and the web in the matrix layer between vertically aligned slots has a vertical dimension $$A = wM_S.$$

Figure 7B:
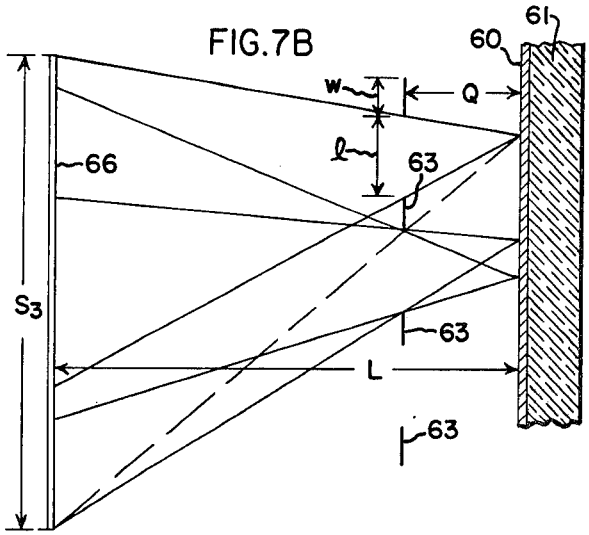
Figure 7B:
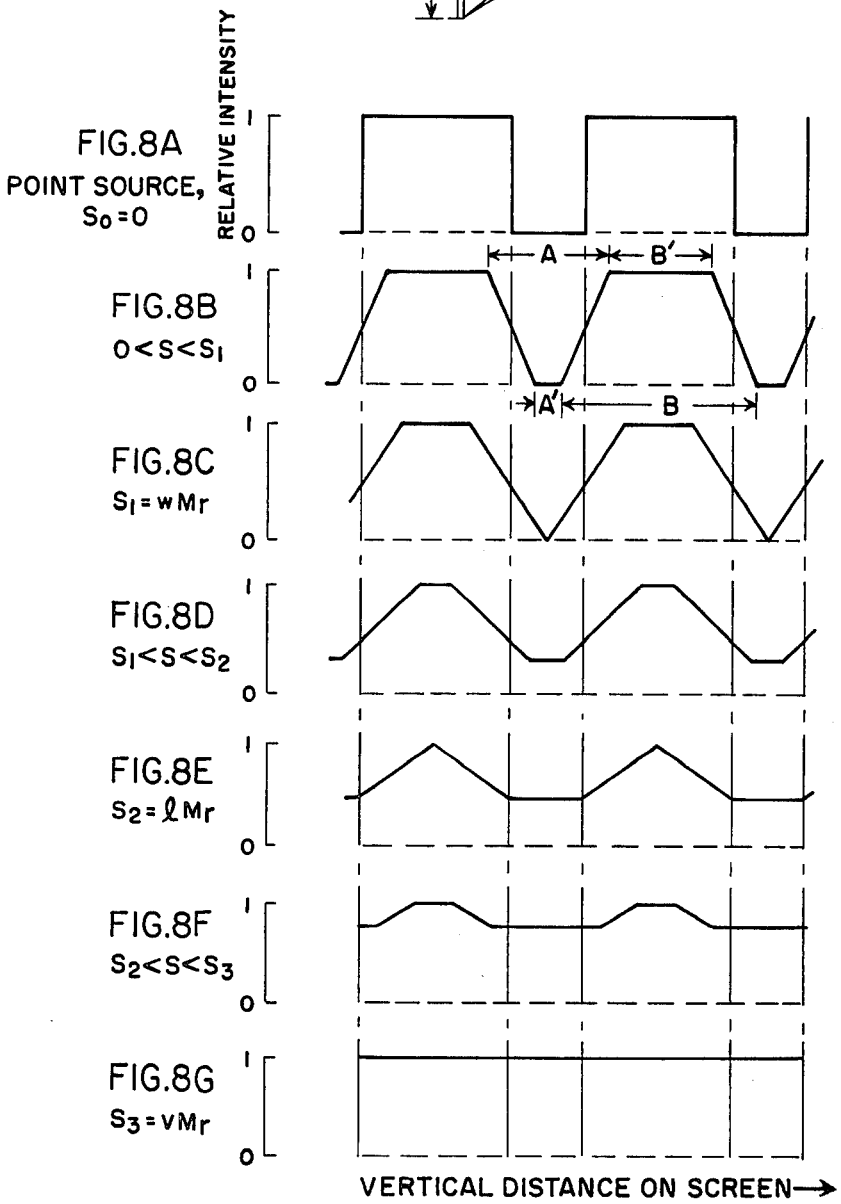

In FIG. 7B, line source 66 of actinic radiation is selected to have a length $S_3$ equal to the reflected magnification of the vertical repeat, or $$S_3 = v\,M_r.$$

Thus, any point on photoresist layer 60 receiving actinic radiation is exposed to an actinic radiation line of length $S_3$ $(l/v)$. Consequently, intensity of radiation falling on photoresist layer 60 along a vertical line is substantially uniform, and conventional processing of the tube thereafter produces a screen of the type illustrated in FIG. 5.

Source lengths ranging between $S_3$ and $S_0$ can be used to produce various intensity distributions. Thus, in FIGS. 8A–8G, and as specifically identified in FIG. 8B, A and A′ denote the partial and complete mask web shadow vertical length, respectively, on the photoresist, while B and B′ denote the partial and complete vertical illumination, respectively, of the photoresist through a mask slot. FIG. 8A represents vertical distribution of illumination intensity on the photoresist layer employed with the apparatus illustrated in FIG. 7A, FIG. 8G represents vertical distribution of illumination intensity on the photoresist layer employed with the apparatus illustrated in FIG. 7B, and FIGS. 8B–8F represent vertical distribution of illumination intensity on the photoresist layer using actinic radiation sources of lengths intermediate those illustrated in FIGS. 7A and 7B. Assuming the length of any actinic radiation source, in general, is S, and that length $S_0$ shown in FIG. 7A is O, the conditions produced by processing according to FIGS. 8A–8C may be expressed as:

$$A = wM_S + SM_i$$

$$A' = wM_S - SM_i$$

$$B = lM_S + SM_i$$

$$B' = lM_S - SM_i$$

and $$A + B' = A' + B = vM_S.$$

For the cases of FIGS. 8D–8G, overlapping images are produced so that the equations to determine A, B, A′ and B′ for any given line on the photoresist layer must be applied to all the mask slots contributing to illumination of that line, and to all the mask webs vertically separating the latter slots.

From FIGS. 8A–8G, it becomes evident that it is possible to produce a black matrix pattern wherein black webs vertically-adjacent openings may, in the vertical direction, be made larger or smaller than the magnified image of the mask web $(wM_A)$, depending on the length of actinic radiation source and exposure time. The selection of variables for any given case may readily be optimized empirically. For example, the screen of FIG. 5 may be produced even if actinic radiation source length S is shorter than $S_3$ of FIG. 7B, provided that sufficient exposure time is allowed so that points of minimum radiation intensity receive the required intensity level for the exposure time allowed.

Vertical repeat $v$ is chosen to minimize moire for any given tube design, and mask web dimension $w$ is usually selected to be the smallest value that will provide the mask with adequate mechanical stability. Typical ranges are $$20 < v < 50$$

and $$3 < w < 10.$$

Typical magnification values for $M_S$ are in the range of 1.03 to 1.06.

As an example, assume $v$ is chosen to be approximately 30 and $w$ is chosen to be approximately 5. Consequently, $l$ is 30−5, or approximately 25. Choosing $M_S$ to be approximately 1.04, $M_i$ is 1.04 −1 or approximately 0.04 and $M_r$ is 1.04/0.04 or approxmately 26. Then $S_1$ is approximately 0.130 inches for the case illustrated in FIG. 8C, $S_2$ is approximately 0.650 inches for the case illustrated in FIG. 8E, and for the case illustrated in FIG. 8G (and in FIG. 7A), $S_3$ is approximately 0.780 inches.

Actinic radiation source lengths used to produce screens of the type shown in FIG. 5 may typically be on the order of 0.5 to 1 inches in length. To produce screens of the type shown in FIG. 6A, typical actinic radiation source lengths may be 0.2 to 0.3 inches. Actinic radiation source lengths for producing screens of the type shown in FIG. 6B are shorter and, for convenience, may comprise round configurations having diameters on the order of 0.050 to 0.150 inches.

The foregoing describes a new and improved color television picture tube of the black matrix type exhibiting reduced screen reflectivity and enhanced image contrast. The tube is of the slotted aperture mask type having a screen, as seen from the viewing side, formed of a plurality of vertically-oriented linear phosphor regions demarcated by openings in the black matrix material. The tube is capable of operating in a positive or negative guardband mode of operation in the vertical direction. A method of fabricating the picture tube is also described wherein exposures to different levels of actinic radiation are employed sequentially in forming the picture tube screen.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. In a cathode ray tube including a faceplate and a shadow mask containing an array of vertically oriented slotted apertures for restricting electron beams directed therethrough to impinge upon and excite selected areas of phosphor material on said faceplate, a viewing screen comprising:

a horizontally repetitive pattern of sets of three vertically oriented stripes of phosphor material extending vertically across and coating the inside surface of said faceplate, each stripe within a set being of different phosphor material so as to emit a different color when excited by the corresponding one of the three electron beams passing through the associated aperture in said shadow mask, and a layer of light absorbing material coating the inside surface of said faceplate and containing a vertical and horizontal array of vertically oriented slotted openings, said stripes and openings being juxtaposed so that said openings define viewable portions of said stripes, each viewable portion being totally surrounded with light absorbing material, said openings and stripes being aligned with the apertures in said shadow mask so that a corresponding one of said three electron beams is allowed to impinge upon each viewable portion, the vertical dimension of each opening being greater than the vertical dimension of that part of said viewable portion excited by the electron beam impinging thereupon, such that a positive vertical guardband is provided, and the horizontal dimension of each opening being less than the horizontal dimension of the impinging electron beam, such that a negative horizontal guardband is provided.

2. In a cathode ray tube including a faceplate and a shadow mask containing an array of vertically oriented slotted apertures for restricting electron beams directed therethrough to impinge upon and excite selected areas of phosphor material on said faceplate, a viewing screen comprising:

a series of vertically oriented stripes of phosphor material extending across and coating the inside surface of said faceplate, the phosphor material of horizontally successive stripes differing in a repetitive pattern so as to emit different colors within each pattern when excited by electron beams, and a layer of light absorbing material coating the inside surface of said faceplate in the form of a matrix comprising vertical stripes of material interposed between the phosphor stripes and horizontal spans of material crossing said phosphor stripes, the vertical stripes and horizontal spans of light absorbing material defining the viewable portions of said phosphor stripes, the vertical dimension of said horizontal spans being less than or equal to the vertical region of each phosphor stripe between vertically adjacent beam landings not excited by said electron beams, such that a zero to positive vertical guardband is provided for each viewable portion, the horizontal dimension of the vertical stripes of light absorbing material being greater than the horizontal separation between horizontally adjacent phosphor stripes, such that a negative horizontal guardband is provided for each viewable portion.

3. In a cathode ray tube including a faceplace and a shadow mask containing an array of vertically oriented slotted apertures for restricting electron beams directed therethrough to land upon and excite selected areas of phosphor materials on said faceplate, a viewing screen comprising:

a layer of light absorbing material coating the inside surface of said faceplate and comprising a web containing an array of vertically oriented slotted openings therein, there being a unique set of three horizontally spaced openings for each aperture of said shadow mask aligned to receive the electron beams passing through said aperture, and a layer of phosphor material coated on the inside surface of said faceplate within the boundaries of said openings, there being a different phosphor material for each of the openings of a set so as to emit a different color when excited by the electron beam impinging thereupon, the height of said web between vertically adjacent sets of openings being less than or equal to the vertical distance between vertically adjacent beam landings to provide a zero to positive vertical guardband for each phosphor area, the width of said web between horizontally adjacent openings being greater than the horizontal distance between horizontally adjacent beam landings to provide a negative horizontal guardband for each phosphor area.

* * * * *